United States Patent [19]

Pohlman et al.

[11] 4,190,993

[45] Mar. 4, 1980

[54] LINER CONSTRUCTION

[76] Inventors: Joe C. Pohlman, P.O. Box 15098, Pittsburgh, Pa. 15237; James P. Romualdi, 5737 Wilkins Ave., Pittsburgh, Pa. 15213

[21] Appl. No.: 931,607

[22] Filed: Aug. 7, 1978

[51] Int. Cl.[2] ..... E04B 1/32

[52] U.S. Cl. ..... 52/249; 52/744; 264/32

[58] Field of Search ..... 52/249, 245, 244, 267–269, 52/410, 378–382, 744, 745, 309.12; 220/408, 468; 138/148–151; 98/58; 110/184; 264/17, 32

[56] References Cited

U.S. PATENT DOCUMENTS

| | | | |
|---|---|---|---|
| 1,344,608 | 6/1920 | Alston | 52/249 |
| 1,538,780 | 5/1925 | Anderson | 138/148 |
| 2,313,325 | 3/1943 | Dalton | 52/378 |
| 3,457,890 | 7/1969 | Rivas et al. | 114/74 A |
| 3,491,711 | 1/1970 | Demo | 114/65 A |

FOREIGN PATENT DOCUMENTS

| | | | |
|---|---|---|---|
| 2307928 | 11/1976 | France | 52/309.12 |
| 703538 | 2/1954 | United Kingdom | 52/224 |

OTHER PUBLICATIONS

National Fisherman, Apr., 1971 article entitled "Ferro-Cement 'Myths' Taken Apart," 3 pages.

The Cement and Concrete Association of Australia Publication entitled "Ferro Cement Boats."

*Primary Examiner*—James L. Ridgill, Jr.
*Attorney, Agent, or Firm*—Paul Bogdon

[57] ABSTRACT

A liner construction for stack-like structures, such as industrial and utility type chimneys and method for forming such a construction are disclosed. The liner includes a plurality of rods or cables supported at their upper ends to an upper portion of a chimney structure and extends downwardly within the chimney and over a substantial length of the height of the chimney. A plurality of hoops or the like are secured to the rods to form a framework of open sections. Mesh is secured to the framework. A body of non-metallic settable material such as concrete encases the mesh and framework. Tubular heat insulation may be secured to the framework to abut the outer surface of the concrete body. The method for forming the liner includes the initial step of suspending a tubular framework of open sections from an upper portion of a chimney to extend downwardly within the confines of the chimney and over a substantial length of the chimney height. Mesh is secured to the framework to define a generally tubular shell. A mortar of non-metallic settable material such as concrete is applied to the mesh beginning at the bottom and continuing upwardly to the top of the shell to complete the liner.

15 Claims, 10 Drawing Figures

LINER CONSTRUCTION

BACKGROUND OF THE INVENTION

This invention relates to a liner construction for stacklike structures such as chimneys of the type used in industrial and utility applications. Also, this invention relates to a method of forming such a liner construction.

This invention will be described in all its aspects with reference to chimneys. It is to be understood, however, that this invention is not limited to chimneys but is intended to include any large elongated stack-like structures in which a liner is required. Such other stack-like structures might be air shafts in underground mines, casings for subterranean wells, or the like.

Chimneys used in industrial and utility settings are very large in size sometimes exceeding over 1000 feet in height. The main purpose of such tall chimney structures is to disperse gaseous products to reduce their ground level concentrations. Various kinds of gaseous products under varying conditions of temperature and pressure are discharged from chimneys. For handling different kinds of gaseous products different types of of liners are provided within the chimney structures. Typical chimney liners are formed of steel, acid-resistant brick, mortar, and chemical resistant fiberglass-reinforced plastic. The conditions under which the gaseous products are passed through the chimney also has a bearing on the type of liner used. For example, if the gaseous product were sulfuric acid-laden and at a temperature of around 600° F. and at a negative pressure, a liner of brick held together with acid and sulfation resisting mortar would be used. Should that same gaseous product, however, be under a positive pressure a steel liner would be used since brick is not impervious and therefore would be subject to leaking. Where the gaseous products contain a corrosive constituent a protective coating material may be pneumatically or otherwise applied to a brick or steel liner. Also, in a corrosive atmosphere a fiberglass-reinforced plastic may be used in combination with a brick or steel liner, or by itself should that be desirable.

All of the types of liners mentioned above have inherent drawbacks. As already stated an all brick and mortar liner is pressure limited as well as limited in the types of gaseous products it can safely handle. In addition brick liners are time consuming and expensive to install. The same may be said of fiberglass-reinforced plastic liners which must be first formed on large mandrels and then installed in sections. Steel liners are formed generally by welding sections together as they are positioned in place which is also a slow, expensive, and cumbersome process.

The liner construction and method of forming it of this invention successfully overcome the disadvantages and limitations of the chimney liners heretofore used typical of which are those described above. The liner construction of this invention is simple in structure, easy to install and does not require any special equipment or forms. In addition this invention is easily adaptable for handling different gaseous products under varying operating conditions.

SUMMARY OF THE INVENTION

The present invention provides a novel liner construction for stack-like structures such as chimneys or the like, the liner preferably comprising: a plurality of circumferentially spaced elongated rod-like members secured at one of their respective ends to an upper portion of the structures and extending downwardly within the confines of the structure and over a substantial length of the height of the structure; a plurality of longitudinally spaced hoop members secured to the rod-like members to define a framework of open sections; wire mesh secured to the framework; and a tubular body of non-metallic settable material such as concrete encasing the mesh and framework and extending over a substantial portion of the height of the structure. In one preferred embodiment of the invention the liner is formed from what is commonly known as ferrocement. As such, the wire mesh has openings of a dimension within the range of between about 0.25 and 1.0 inches with the wire size being of a dimension such that the total amount of reinforcement is not less than about 5.0 pounds per cubic foot of reinforced material which could be a non-shrinking, corrosive-resistant concrete, for example. The method of forming the liner construction preferably comprises the steps of suspending a tubular framework of open sections from an upper portion of the structure to extend downwardly within the confines of the structure and over a substantial length of the structure height; securing wire mesh to the framework to define a generally tubular shell; and applying a mortar of non-metallic settable material, such as a suitable concrete mixture, to the shell to a degree such that the set material is reinforced by the mesh, beginning at the bottom and continuing upwardly to the upper portion of the shell, the mortar being applied until at least the mesh is encased and the liner completed. In one form of the method of this invention, the liner is formed by applying the settable material in stages and allowing each stage to cure before the next stage is formed. The steps of applying the material and curing the stages are repeated until the liner is completed.

The liner construction of this invention is simply and easily formed without the need of elaborate equipment or forms. The overall thickness of the liner is relatively thin, as compared with ordinary reinforced concrete, is virtually crack free, and relatively ductile which allows it to resist loadings such as those caused by thermal gradients and vibrations. Also, the liner construction is readily adapted to different gaseous products operating under differing temperature and pressure conditions by simply making a mixture of settable material which would meet the specific requirements desired. For example, special acid resistant materials may be added to conventional shrink resistant concrete to provide a corrosive resistant liner.

Various other advantages, details and modifications of the present invention will become apparent as the following description of certain present preferred embodiments and present preferred methods of forming the embodiments proceed.

DESCRIPTION OF THE DRAWINGS

In the accompanying drawins we show a certain present preferred embodiment of this invention in which:

Referring now to the drawings, FIGS. 1–6 illustrate one embodiment of the liner construction and method of forming the same of the present invention. There is shown a chimney structure 10 of any well known form for use in industrial or utility applications. An annular shaped flange-like hanger 12 is appropriately secured to the mouth portion of the chimney 10. A plurality of elongated rod-like members 14 which may be steel rods or cables are secured at their upper ends to the hanger 12 and are uniformly arcuately spaced in a generally cylindrical pattern. The rod-like members 14 will be hereinafter referred to rods 14 for ease of description. The rods 14 extend the full height of the chimney 10 although that is not vital so long as some of them extend the full distance as will be more fully explained hereinafter. A plurality of ring shaped hoops 16 are secured in regular longitudinal spacing to the rods 14 with suitable menas such as by welding or with clamps. Together the rods 14 and hoops 16 form a framework 20 of open sections as diagrammatically illustrated in FIG. 5.

Figure 1:
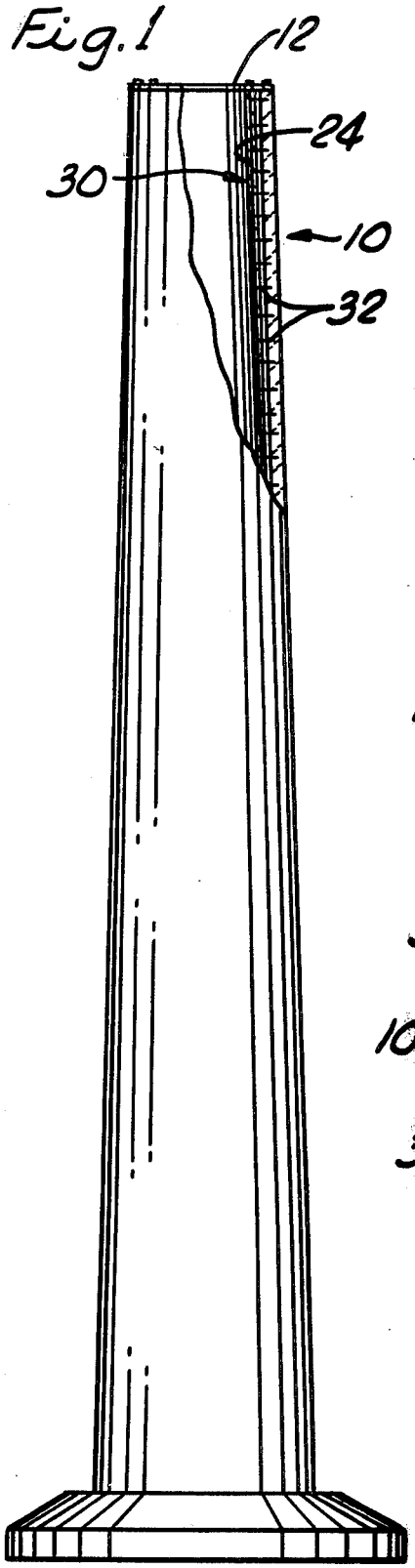
FIG. 1 is an elevation view partly in section of a chimney structure having a liner construction embodying the present invention.
Figure 2:
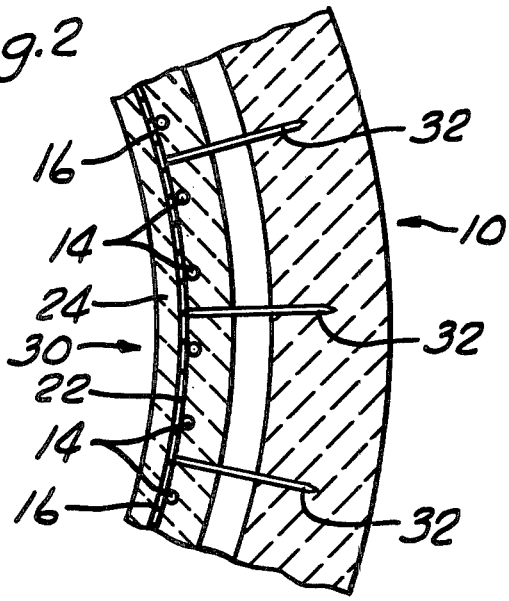
FIG. 2 is an enlarged fragmentary horizontal sectional view of the chimney of FIG. 1.
Figure 3:
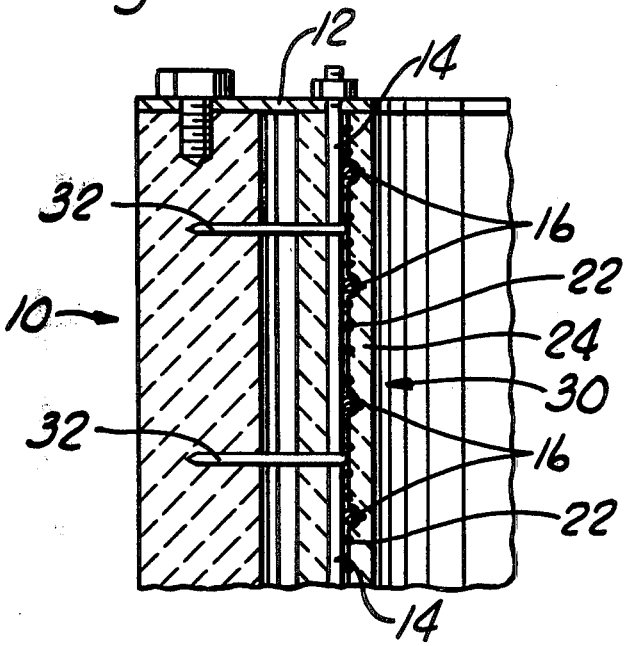
FIG. 3 is an enlarged fragmentary vertical view of the chimney of FIG. 2.

A single layer of steel wire mesh 22 is suitably secured to the inner section of the framework 20. Cylindrical sections of solid and rigid foam heat insulation of any well known composition may be attached to the outer section of the framework 20. The mesh 22 is encased by a body 24 of non-metallic settable material such as a non-shrinking corrosion resistant concrete although any other material having the general physical properties of concrete may be used. The body 24 is formed by impregnating a mortar of the desired material through and around the mesh 22 by either spraying or hand trowelling. In so forming the body 24, should insulation be secured to the frame 20 it would serve as a back-up form for the mortaring step of the method of this invention.

One or more layers of mesh 22 may be used in forming the liner which will generally be represented by the numeral 30. In the embodiment of FIGS. 1–6, the mesh 22 has openings of a dimension within the range of about 0.25 and 1.0 inches with the mesh being of a dimension such that the total amount of reinforcement is not less than about 5.0 pounds per cubic foot of reinforced material. As stated earlier the body 24 encases the mesh 22, and covers the faces of the mesh by a thickness in the order of an eighth of an inch or so. The mesh 22 reinforced body 24 thus formed is known to those skilled in the art as ferrocement. The light-weight, high tensile strength, ductility, and impact resistance properties of the ferrocement liner 30 are also well known to those skilled in the art.

Ferrocement is defined in the art as follows. It is a term used to describe a composite material consisting of mortar and finely dispersed reinforcing material which is usually steel but could be other metallic or non-metallic materials. Essentially a form of reinforced concrete, it exhibits substantially improved properties of toughness, strength and crack resistance. It differs from conventional reinforced concrete in that its reinforcement consists of a single layer of closely spaced or even touching, multiple layers of mesh uniformly and continuously distributed throughout the length, breadth and thickness and is completely encased with cement or any other suitable mortar. The spacing of the mesh is within the range of 0.25 and 1.0 inches and usually no greater than 0.5 inch. Ferrocement may be formed in sections less than 1.0 inch thick, with only a fraction of an inch of mortar cover over the outermost mesh layer or layers. With respect to this definition of ferrocement, it should be noted that it, and therefore this invention, contemplates the use of any non-metallic settable material having the general physical properties of concrete and is not to be construed as being limited to cement mortar or a non-shrinking concrete.

The mesh 22 used is defined as a relatively closely spaced array of thin elements, such as metal wire. The array is usually rectangular but may also be triangular or octagonal, and may be formed by weaving or fastening the separate elements to each other as by welding. The dimensional range of the spacing and wire size were defined hereinabove.

Figure 4:
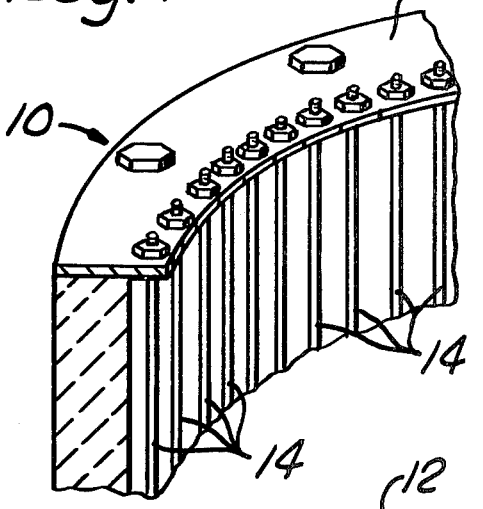
FIGS. 4–6 are perspective sectional views diagrammatically illustrating the steps in forming the liner construction of this invention.
Figure 5:
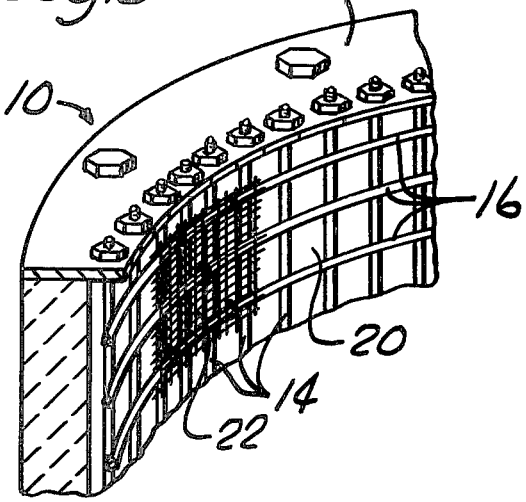
Figure 6:
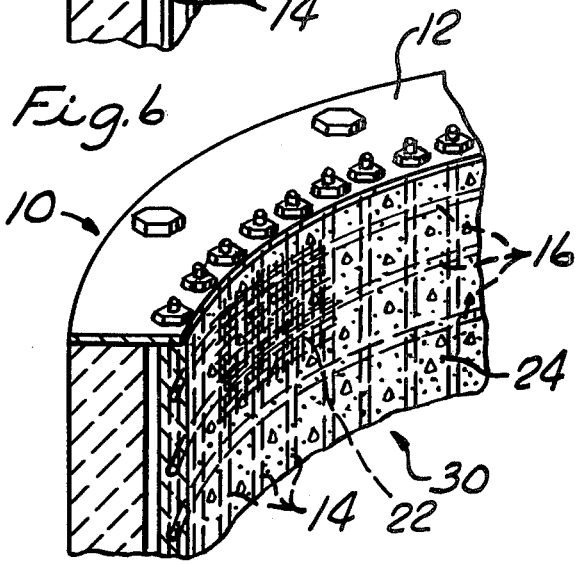

FIGS. 4–6 diagrammatically illustrate the progression in forming the liner 30. The rods 14 are secured to the hanger 12 followed by the hoops 16 being fixed to the rods to form the framework 20. The mesh 22 is then installed and then the body 24 is formed by applying the desired mortar to encase the mesh and the framework 20. Should heat insulation be required, the insulation would be installed after the mesh 22 is installed securing it to the framework 20 or to the inner wall of the chimney. In forming the liner 30 it would be preferred to begin from the bottom of the framework 20 to form a cylindrical section and then allowing that section to cure either partially or completely. That same procedure would then be followed on the next higher adjacent stage and repeated until the liner 30 is completed. When a stage of mortar-mesh-framework is cured it is thus stress-freee and can thereby utilize its full strength to resist subsequent loads as those due to thermal gradients or vibrations due to high velocity stack gases.

As those skilled in this art will recognize all of the vertical load of the liner 30 is taken by the rods 14. The total load carried increases linerarly from the bottom to the top. For this reason, all of the rods 14 need not extend throughout the full height of the chimney 10. More rods 14 would be placed near the top of the liner 30 with the rest extending downwardly to intermediate levels. Such an arrangement permits the rods 14 to be stressed at or near their design strength which results in an economical installation.

The material used in forming the liner 30 was described earlier. It should be noted, however, that special acid resistant formulations may be used to resist corrosive flue gases common to many installations. It is also to be noted that the liner 30 described uses all the elements to their best advantage. The rods 14 can be proportioned to be highly stressed for maximum economy. The mortar-mesh 22 composite, on the other hand, is stress-free after curing and, therefore, need only be an inch or so thick.

Other modifications of this invention are available. A few will now be mentioned. In the event the liner 30 becomes too flexible when freely suspended as illustrated, intermediate supports 32 may be provided between the chimney inner wall and the framework 20.

Also, the hanger 12 may be covered with mesh and mortar whereby all the support steel would be covered to prevent corrosion. In addition, the hoops 16 may be secured to the outside of the rods 14 or alternated by placing one on the outside followed by one on the inside of the rods.

Figure 8:
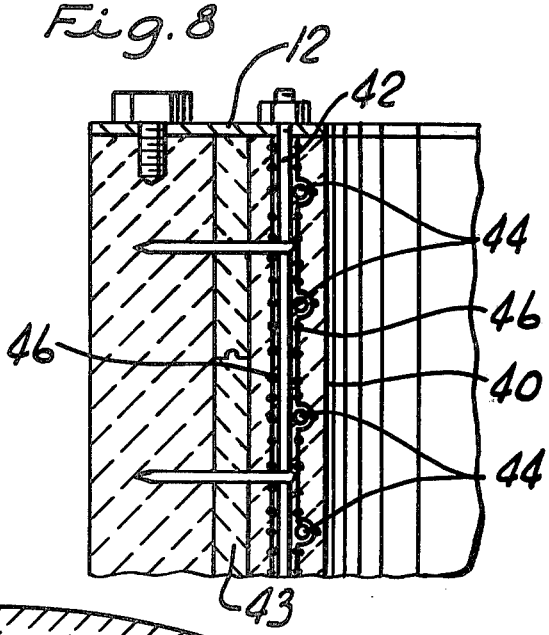
FIG. 8 is a view taken along the line VIII—VIII of FIG. 7.
Figure 7:
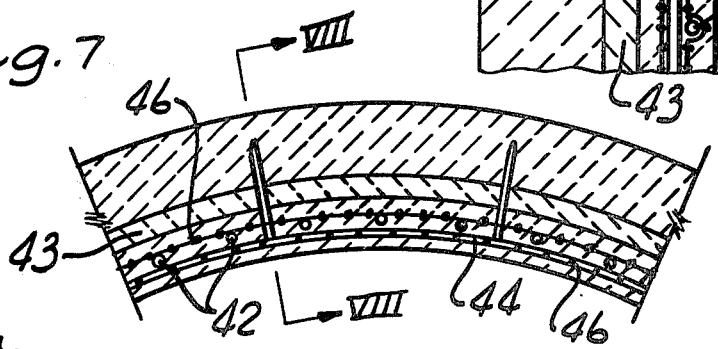
FIG. 7 is a cross-sectional plan view of another embodiment of the liner construction of the present invention showing a double layer of mesh.
Figure 9A:
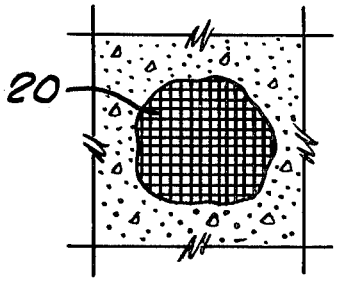
FIGS. 9*a* and 9*b* are a pair of diagrammatic views of portions of the mesh elements of the embodiment shown in FIGS. 1 and 7 illustrating the relative mesh sizes between the two elements.
Figure 9B:
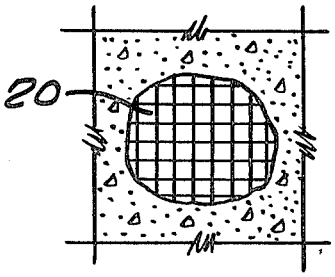

FIGS. 7 and 8 illustrate another embodiment of the liner construction of the present invention. In that embodiment, the liner 40 is formed in the same manner as the earlier described liner 30. Thus rods 42 and hoops 44 are secured to form a framework, with mesh 46 being secured on both sides of the framework. Cylindrical sections of heat insulation 43 of any well known composition are attached to the inner wall of the chimney. The insulation 43 serves the dual function of a back-up form for the mortar as the liner is formed and heat insulation for the chimney wall. In this embodiment the size of the mesh 46 is greater than that of the mesh 22 of the first embodiment, and would have a spacing of between about 2.0 and 6.0 inches. The mesh 46 is encased by a fiber reinforced non-metallic settable material having the general physical properties of concrete. The material may be concrete with the fibers being stainless steel although other metallic or non-metallic fibers may be used. Because of the size of mesh 46 a back-up such as the insulation 43 would be required for forming liner 40.

The liner 40 is also tough and crack-resistant and would resist chemical corrosion as well as stresses due to thermal gradients or vibration. The other advantages and modifications mentioned in regard to the first embodiment apply to this second embodiment.

While we have shown and described certain present preferred embodiments of this invention and have also described a present preferred method of forming the embodiments, it is to be distinctly understood that the invention is not limited thereto, but may be otherwise embodied and formed within the scope of the following claims.

We claim:

1. In combination with a stack-like structure having at least an inner wall, a liner comprising:

a plurality of circumferentially spaced elongated rod-like means spaced radially, inwardly from the inner wall of the structure and secured at one of their ends to an upper portion of the structure and extending downwardly within the confines of said structure and over a substantial length of the height of the structure;

a plurality of longitudinally spaced hoop means secured to said rod-like means, whereby said hoop means and said rod-like means together define a framework of open sections;

mesh means secured to said framework; and a tubular body of non-metallic settable material having the general physical properties of concrete encasing said mesh and extending over a substantial portion of the height of the structure; said framework, said mesh and said body of settable material constructed and arranged with respect to each other such that a stress-free liner is defined.

2. In the combination as set forth in claim 1 including tubular insulation means secured to said framework and disposed on the other surface of said body of settable material.

3. In the combination as set forth in claim 1 wherein said mesh means is steel mesh.

4. In the combination as set forth in claim 1 wherein said rod-like means and said hoop means are arranged and constructed with respect to each other such that said framework defined has a pattern of generally rectangular sections.

5. In the combination as set forth in claim 1 wherein some of said rod-like means extend downwardly over a substantial length of the height of the structure and the other of said rod-like means extend downwardly to intermediate levels of the structure height.

6. In the combination as set forth in claim 1 including a plurality of layers or said mesh means.

7. In the combination as set forth in claim 1 wherein said mesh means is secured to both inner and outer portions of said framework.

8. In the combination as set forth in claim 1 wherein said mesh means is wire mesh having opening dimensions within the range of between about 2.0 to 6.0 inches; and wherein said body of settable means is a steel fiber reinforced material body.

9. In the combination as set forth in claim 1 including support means fixed at intermediate positions to the inner wall of the structure and secured to said framework for providing additional support for the liner.

10. In the combination as set forth in claim 1 wherein said mesh means is wire mesh having openings of a dimension within the range of between about 0.25 and 1.0 inches with the size of the wire forming the mesh being of a dimension much that the total amount of reinforcement is not less than about 5.0 pounds per cubic foot of reinforced material.

11. In the combination as set forth in claim 10 wherein said body of settable means encases said mesh means to the extent that the overall thickness of said body is greater by about 0.125 inch on either side of said mesh means.

12. A method of constructing a liner within the confines of a stack-like structure having at least an inner wall comprising the steps of:

suspending a tubular framework of open sections from an upper portion of the structure and radially spaced from the inner wall thereof to extend downwardly within the confines of the structure and over a substantial length of the structure height;

securing mesh to the framework to define a generally tubular shell; and applying a mortar of non-metallic settable material having the general physical properties of concrete to the shell to a degree such that the set material is reinforced by the mesh beginning at the bottom and continuing upwardly to the upper portion of the shell, said applying step performed to the extent of completely encasing at least the mesh and in a manner to form a stressfree liner.

13. A method of constructing a liner as set forth in claim 12 wherein said applying of the mortar is performed in stages, and wherein addition steps are included of permitting the curing of a completed stage of said applying of mortar and repeating said applying and curing steps until the liner is completed.

14. A method of constructing a liner as set forth in claim 12 including the step of supporting heat insulation material between the framework and the inner wall of the structure prior to the step of securing mesh to the framework.

15. A method of constructing a liner as set forth in claim 12 wherein said suspending step includes hanging elongated rod-like means from an upper portion of the structure to extend downwardly within the structure, and fixing hoop members to the rod-like means to form said framework.

* * * * *